US006453855B1

(12) United States Patent
Di Lieto et al.

(10) Patent No.: US 6,453,855 B1
(45) Date of Patent: Sep. 24, 2002

(54) METHOD FOR THE CONTROL OF ELECTROMAGNETIC ACTUATORS FOR THE ACTUATION OF INTAKE AND EXHAUST VALVES IN INTERNAL COMBUSTION ENGINES

(75) Inventors: Nicola Di Lieto, Salerno; Gilberto Burgio, Ferrara; Roberto Flora, Forli', all of (IT)

(73) Assignee: Magneti Marelli S.p.A., Milan (IT)

( * ) Notice: Subject to any disclaimer, the term of this patent is extended or adjusted under 35 U.S.C. 154(b) by 0 days.

(21) Appl. No.: 09/704,670

(22) Filed: Nov. 3, 2000

(30) Foreign Application Priority Data

Nov. 5, 1999 (IT) ..... BO99A0594

(51) Int. Cl.[7] ..... F01L 9/04

(52) U.S. Cl. ..... 123/90.11; 123/90.15; 251/129.1; 251/129.16; 251/129.2

(58) Field of Search ..... 123/90.11, 90.15; 251/129.1, 129.2, 129.16, 129.02; 335/255, 256, 258, 266, 275, 276

(56) References Cited

U.S. PATENT DOCUMENTS

| | | | | | |
|---|---|---|---|---|---|
| 4,375,793 | A | * | 3/1983 | Seilly et al. | 123/90.11 |
| 4,762,095 | A | * | 8/1988 | Mezger et al. | 123/90.11 |
| 4,867,111 | A | * | 9/1989 | Schneider et al. | 123/90.11 |
| 5,076,222 | A | * | 12/1991 | Kawamura | 123/90.11 |
| 5,772,179 | A | * | 6/1998 | Morinigo et al. | 251/129.1 |
| 5,934,231 | A | * | 8/1999 | Schmitz et al. | 123/90.11 |
| 6,003,481 | A | * | 12/1999 | Pischinger et al. | 123/90.11 |
| 6,073,596 | A | * | 6/2000 | Kemper | 123/90.11 |
| 6,196,172 | B1 | * | 3/2001 | Cosfeld et al. | 123/90.11 |
| 6,247,432 | B1 | * | 6/2001 | Pischinger et al. | 123/90.11 |
| 6,276,316 | B1 | * | 8/2001 | Arai et al. | 123/90.11 |
| 6,283,073 | B1 | * | 9/2001 | Izuo et al. | 123/90.11 |
| 6,302,068 | B1 | * | 10/2001 | Moyer | 123/90.11 |

FOREIGN PATENT DOCUMENTS

| | | |
|---|---|---|
| DE | 197 39 840 | 3/1999 |
| EP | 0 727 566 | 8/1996 |
| WO | 98/10175 | 3/1998 |

* cited by examiner

*Primary Examiner*—Teresa Walberg
*Assistant Examiner*—Fadi H. Dahbour
(74) *Attorney, Agent, or Firm*—Arent Fox Kintner Plotkin & Kahn

(57) ABSTRACT

A method for the control of an electromagnetic actuator coupled to a respective valve and provided with a moving ferromagnetic member connected to at least one point of the valve, a pair of electromagnets disposed on opposite sides with respect to the moving ferromagnetic member and an elastic member adapted to maintain the valve in a rest position. The method comprises the stages of detecting an actual position and an actual velocity of the valve, determining a reference position and a reference velocity of the valve and minimising differences between the reference position and the actual position and between the reference velocity and the actual velocity of the valve by means of a feedback control action.

8 Claims, 4 Drawing Sheets

METHOD FOR THE CONTROL OF ELECTROMAGNETIC ACTUATORS FOR THE ACTUATION OF INTAKE AND EXHAUST VALVES IN INTERNAL COMBUSTION ENGINES

The present invention relates to a method for the control of electromagnetic actuators for the actuation of intake and exhaust valves in internal combustion

BACKGROUND OF THE INVENTION

As is known, drive units are currently being tested in which the actuation of the intake and exhaust valves is managed by using actuators of electromagnetic type that replace purely mechanical distribution systems (camshafts). While conventional distribution systems make it necessary to define a valve lift profile that represents an acceptable compromise between all the possible operating conditions of the engine, the use of an electromagnetically controlled distribution system makes it possible to vary the phasing as a function of the engine point in order to obtain an optimum performance in any operating condition.

A number of control systems enabling the valves to be moved by means of electromagnetic actuators according to desired timings have thus been developed.

These control systems have, however, some drawbacks. They are based on open loop control systems and require, when each valve is opened or closed, the actuators to be supplied with corresponding currents and/or voltages of a value such as to ensure that the valve, irrespective of the resistance opposing it, reaches the desired position within a predetermined time interval.

In this way, however, the valve is subject to an impact each time that it comes into contact with fixed members in the position of maximum opening (lower contact) or in the closed position (upper contact). This is particularly critical, since the valves are subject to an extremely high number of opening and closing cycles and therefore wear very rapidly.

Moreover, drive units that use these known control system are undesirably noisy, in particular at low speeds, precisely because of the impacts that take place during the phases of movement of the valves.

SUMMARY OF THE INVENTION

The object of the present invention is to provide a method for the control of electromagnetic actuators that is free from the above-described drawbacks and, in particular makes it possible to guide the movement of the valves during the contact phases corresponding to the open and closed positions.

The present invention therefore relates to a method for the control of electromagnetic actuators for the actuation of intake and exhaust valves in internal combustion engines, in which an actuator, connected to a control unit, is coupled to a respective valve and comprises a moving member actuated magnetically to control the movement of they valve between a closed position and a position of maximum opening and an elastic member adapted to maintain the valve in a rest position, which method is characterised in that it comprises the stages of:

a) detecting an actual position and an actual velocity V of the valve;

b) determining a reference position $Z_R$ and a reference velocity $V_R$ of this valve;

c) minimising differences between this reference position $Z_R$ and the actual position Z and between the reference velocity $V_R$ and the actual velocity V of the valve, by means of a feedback control action.

BRIEF DESCRIPTION OF THE DRAWINGS

The invention is set out in further detail below with reference to a non-limiting embodiment thereof, made with reference to the accompanying drawings, in which.

DETAILED DESCRIPTION OF THE INVENTION

Figure 1:
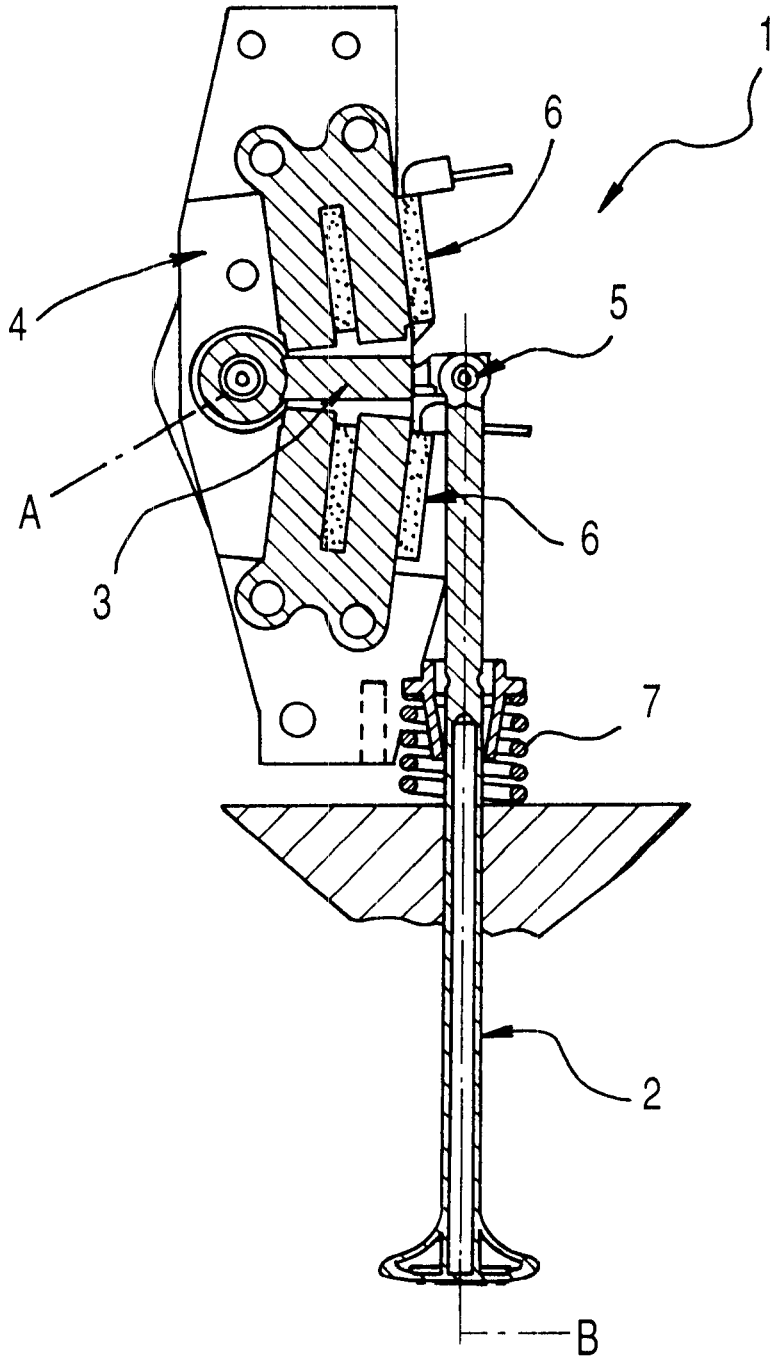
FIG. 1 is a lateral elevation, partly in cross-section, of a first type of intake or exhaust valve and of the corresponding electromagnetic actuator.

In FIG. 1, an electromagnetic actuator 1, controlled by a control system of the present invention, is coupled to an intake or exhaust valve 2 of an internal combustion engine and comprises an oscillating arm 3 of ferromagnetic material, having a first end hinged on a fixed support 4 so as to be able to oscillate about a horizontal axis of rotation A perpendicular to a longitudinal axis B of the valve 2, and a second end connected via a hinge 5 to an upper end of the valve 2, a pair of electromagnets 6 disposed on opposite sides of the body of the oscillating arm 3 so as to be able to act on command, simultaneously or alternatively, by exerting a net force F on the oscillating arm 3 in order to cause it to rotate about the axis of rotation A and an elastic member 7, adapted to maintain the oscillating arm 3 in a rest position in which it is equidistant from the polar heads of the two electromagnets 6, so as to maintain the valve 2 in an intermediate position between the closed position (upper contact, $Z_{SUP}$) and the position of maximum opening (lower contact, $Z_{INF}$) which the valve 2 assumes when the oscillating arm 3 is disposed in contact with the polar head of the upper electromagnet 6 and with the polar head of the lower electromagnet 6 respectively.

For simplicity, reference will be made in the following description to a single valve-actuator unit. It will be appreciated that the method described is used for the simultaneous control of the movement of all the intake and exhaust valves present in a drive unit.

Moreover, reference will always be made to the position of the valve 2 in a direction parallel to the longitudinal axis B, with respect to the rest position assumed to be the starting position.

Figure 2:
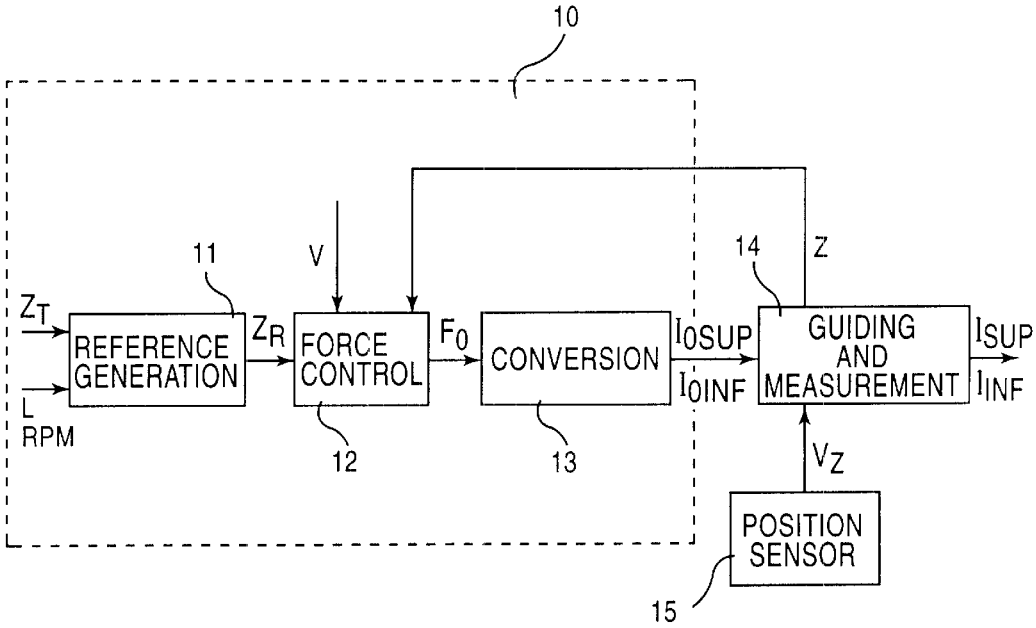
FIG. 2 is a simplified block diagram relating to the control method of the present invention.

As shown in FIG. 2, a control unit 10 comprises a reference generation block 11, a force control block 12 and a conversion block 13 and is further interfaced with a guiding and measurement circuit 14.

The reference generation block 11 receives as input an objective position signal $Z_T$, generated in a known manner by the control unit, and a plurality of parameters indicative of the engine operating conditions (for instance the load L and the number of revolutions RPM).

The reference generation block 11 also supplies as output a reference position profile $Z_R$ and a reference velocity profile $V_R$ and supplies them as input to the force control block 12 which also receives a measurement of the actual position Z and en estimate of the actual velocity v of the valve 2. The measurement of the position Z is supplied by the guiding and measurement circuit 14, as described below, and the estimate of the actual velocity V may be obtained, for instance, by providing the system with an accelerometer adapted to measure the acceleration of the valve 2 and integrating the signal supplied by this accelerometer over time or, as an alternative, recording successive measurement values of the actual position Z and carrying out a derivation of the time series obtained in this way.

The force control block 12 calculates and supplies as output an objective force value Of indicative of the net force F to be applied to the oscillating arm 3 by means of the electromagnets 7 in order to minimise the deviations of the actual position Z and of the actual velocity V with respect to the reference position $Z_R$ and reference velocity $V_R$ profiles respectively.

The conversion block 13 receives as input the objective force value $F_O$ and supplies as output a pair of objective current values $I_{OSUP}$ and $I_{OINF}$ that need to be applied to the upper electromagnet 6 and the lower electromagnet 6 respectively in order to generate the objective force value $F_O$.

The guiding and measurement circuit 14, of known type, receives as input the objective current values $I_{OSUP}$ and $I_{OINF}$ and causes the corresponding upper and lower electromagnets 6 to be supplied with respective currents $I_{SUP}$ and $I_{INF}$.

It is connected, moreover, to a position sensor 15 of known type adapted to detect the position of the valve 2 or, in an equivalent way, of the oscillating arm 3. The position sensor supplies a signal $V_Z$ indicative of the actual position Z of the valve 2 to the guiding and measurement circuit 14 which in turn supplies the measurement of the actual position Z to the control unit 10 and in particular to the force control block 12.

During the operation of the engine, the control unit 10, using known strategies, determines the moments of opening and closing of the valve 2. At the same time, it sets the objective position signal $Z_T$ to a value representative of the position that the valve 2 should assume. The objective position signal $Z_T$ is in particular assigned an upper value $Z_{SUP}$ corresponding to the upper contact or a lower value $Z_{INF}$ corresponding to the lower contact, depending on whether the control unit 10 has supplied a closing or opening command to the valve 2.

On the basis of the values of the objective position signal $Z_T$, the load L and the number of revolutions RPM, the reference generation block 11 determines the reference position profile $Z_R$ and the velocity reference profile $V_R$ which respectively represent the position and the velocity which, as a function of time, it is desired to impose on the valve 2 during its displacement between the positions of maximum opening and closure. These profiles may for instance be calculated from the objective position signal $Z_T$ by means of a two-state non-linear filter, implemented in a known manner by the reference generation block 11, or taken from tables drawn up at the calibration stage.

Figure 3:
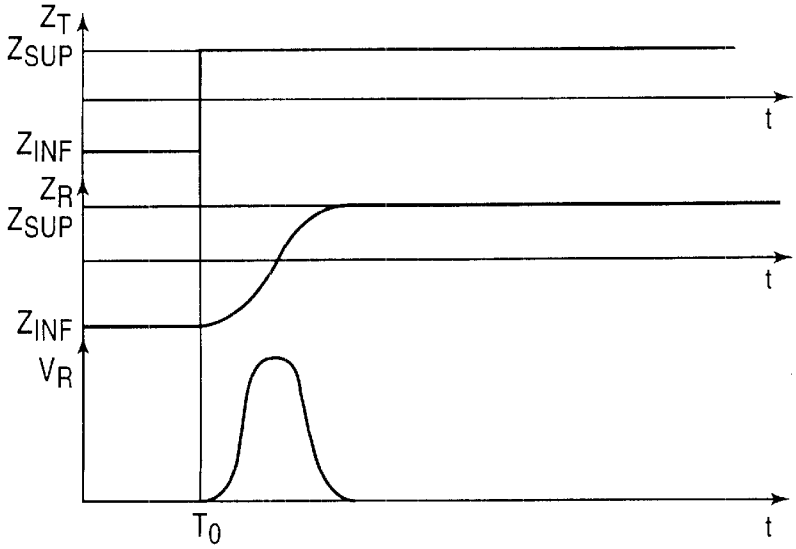
FIG. 3 shows examples of reference movement profiles implemented according to the present method.

FIG. 3 shows an example relating respectively to a position profile $Z_R$ and a velocity profile $V_R$ generated, at a time $T_O$, together with a command to close the valve 2. As will be seen, the profiles are defined such that the valve 2 slows down in the end section of its stroke, in order to avoid an abrupt impact on the fixed members.

The force control block 12 therefore uses the reference position profiles $Z_R$ and velocity reference profiles $V_R$, together with the values of the actual position Z and the actual velocity V, to determine the objective force value $F_O$ of the net force F that needs to be applied to the oscillating arm 3, according to the following equation:

$$F_O=(N_1Z_R+N_2V_R)-(K_1Z+K_2V) \tag{1}$$

In (1), $N_1$, $N_a$, $K_1$ and $K_2$ are gains that can be calculated by applying well-known control techniques to a dynamic system 20 (shown in FIG. 4) that represents the movement of the valve 2 and is described by the matricial equation:

$$\begin{bmatrix} \dot{Z} \\ \dot{V} \end{bmatrix} = \begin{bmatrix} 0 & 1 \\ K/M & B/M \end{bmatrix} \begin{bmatrix} Z \\ V \end{bmatrix} + \begin{bmatrix} 0 \\ 1/M \end{bmatrix} F \tag{2}$$

in which Z and V are the time derivatives of the actual positions Z and respectively of the actual velocity V, K is an elastic constant, B is a viscous constant and M is an equivalent total mass. In particular, the net force F and the real position Z represent an input and respectively an output of the dynamic system 20.

Figure 4:
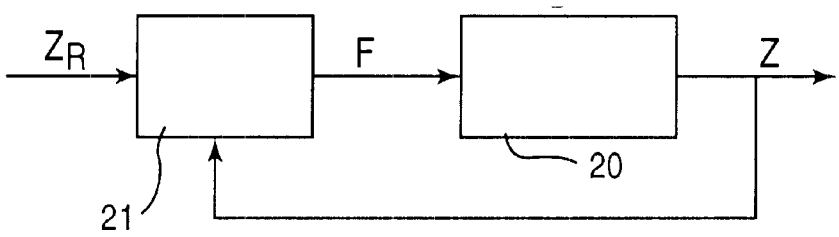
FIG. 4 is a simplified block diagram of a feedback-based dynamic system implementing the present method.

The force control block 12 therefore carries out, with respect to the dynamic system 20, the function of a feedback controller, shown by 21 in FIG. 4, which uses the net force F as the control variable in order to impose that the controlled variable, i.e. the real position Z, has a course that is as close as possible to a predetermined course provided by the reference position profile $Z_R$.

As mentioned above, the objective force value $F_O$ calculated by the force control block 12 according to equation (1) is used by the conversion block 13 to determine the objective current values $I_{OSUP}$ and $I_{OINF}$ of the respective currents $I_{SUP}$ and $I_{INF}$ that need to be supplied to the upper and lower electromagnets 6. These current values may be obtained in a manner known per se by inversion of a mathematical model or on the basis of tables representative of distance-force-current characteristics.

Figure 5:
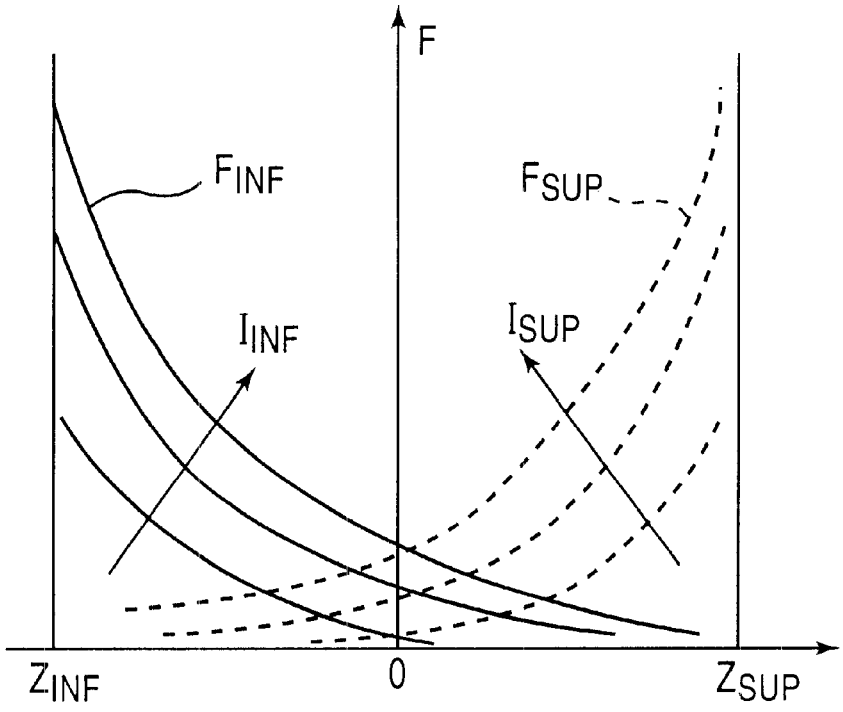
FIG. 5 shows graphs relating to distance-force-current characteristics of electromagnetic actuators.

An example of these characteristics is shown in the graph of FIG. 5, with reference to the valve-electromagnets unit as described.

In detail, the position of the oscillating arm 3 with respect to the electromagnets 6 is shown on the abscissa; the origin is set at the rest point in which the oscillating arm 3 is equidistant from the polar heads of the two electromagnets 6, while the points $Z_{SUP}$ and $Z_{INF}$ represent the upper contact and the lower contact respectively. With the variation of the currents $I_{SUP}$ and $I_{INF}$ absorbed by the upper and lower electromagnets 6, the forces generated by these on the oscillating arm 3 are illustrated by a first family of curves, shown by continuous lines and indicated by $F_{SUP}$ and, respectively, a second family of curves, shown by dashed lines and indicated by $F_{INF}$.

It should be stressed that both the electromagnets 6 can be supplied during a same closing or opening stroke of the valve 2, to enable the net force F exerted on the oscillating arm 3 to have a value equal to the objective force value $F_O$. For instance, during a closing stroke, in which the valve 2 moves between the position of maximum opening and the closed position, the upper electromagnet 6 is initially supplied; if the actual velocity V of the valve 2 exceeds the reference velocity $V_R$, the force control bock 12 generates an objective force value $F_O$ such as to exert a braking action on this valve 2. This braking action is thus obtained by de-activating the upper electromagnet 6 and supplying the current $I_{INF}$ to the lower electromagnet 6 while the valve 2 is still moving towards the upper contact $Z_{SUP}$. Vice versa, during an opening stroke, in which the valve 2 is moving between the closed position and the position of maximum opening, the upper electromagnet 6 is used to brake the valve 2, while the lower electromagnet 6 makes it possible to impose an acceleration thereon.

The stages of supply and de-activation of the electromagnets 6 in order to accelerate or brake the valve 2 as described above may be repeated in sequence several times during each opening and closing stroke so as to minimise the deviations of the actual position Z and the actual velocity v of the valve 2 from the reference position profile Z, and the reference velocity profile $V_R$ respectively.

The method described above has the following advantages.

In the first place, the feedback control makes it possible to actuate the valves according to predetermined movement profiles. It is in particular possible to impose a desired velocity trend, moderating it at the end-of-stroke sections, so that the contact between the valves and the fixed members takes place gently. This makes it possible to obtain a so-called "soft touch", avoiding impacts that would substantially reduce the life of the valves and would make the use of electromagnetic actuation systems problematic for mass produced vehicles.

Moreover, the use of moderated velocity profiles makes it possible substantially to reduce the noise generated by the drive unit, thereby improving its silencing in particular at low speeds.

Further advantages are provided by the use of the net force F as a control variable, making it possible to carry out accurate control and, at the same time, to optimise the currents absorbed by the electromagnets. These currents must ensure only that the net force F applied to the oscillating arm has a value equal to the objective force value $F_O$. According to known methods, however, the electromagnets must absorb currents sufficient to ensure the displacement of the valve between the upper and lower contacts irrespective of the force actually required. A safety margin therefore has to be provided and high currents are therefore supplied to the electromagnets. It will therefore be appreciated that the method proposed advantageously makes it possible to reduce current consumption and substantially to improve the overall performance of the drive unit. As a result of the lower current absorption, there is less risk of damage to the windings of the electromagnets as a result of overheating.

Figure 6:
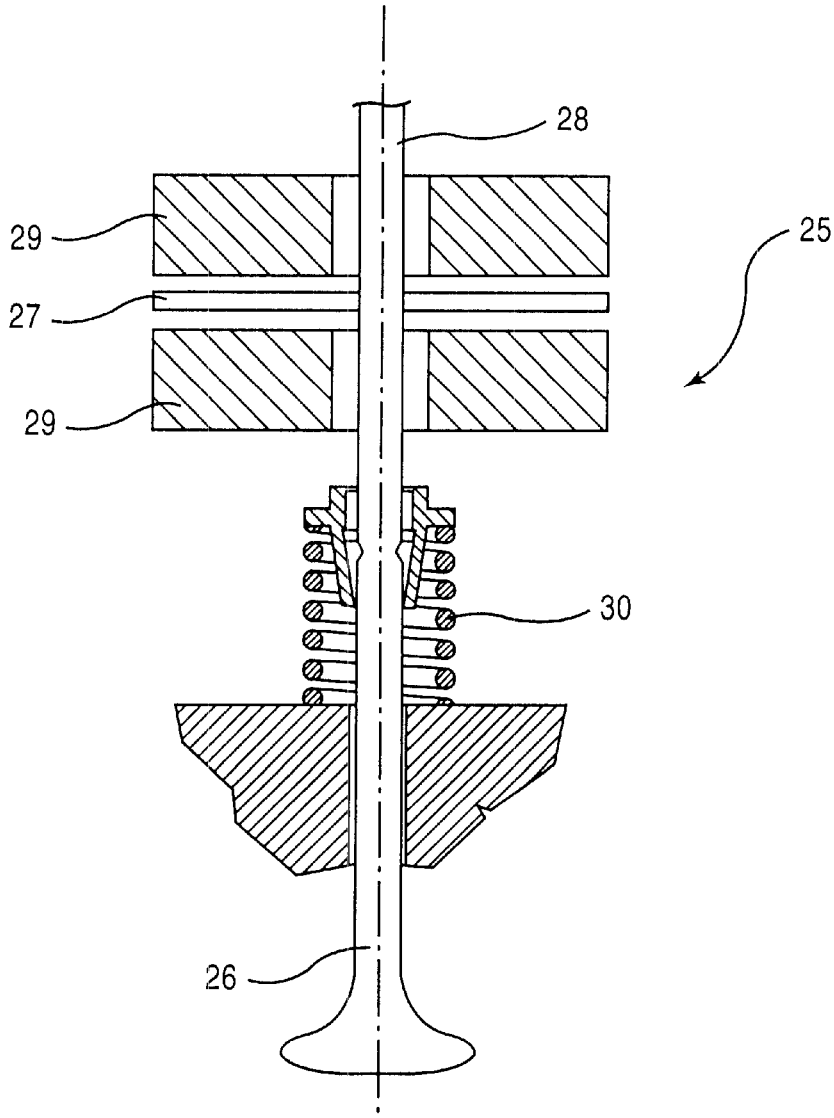
FIG. 6 is a lateral elevation, partly in cross-section, of a second type of intake or exhaust valve and of the corresponding electromagnetic actuator.

The method proposed may, moreover, also be used for the control of valve actuator units other than those described with reference to FIG. 1. For instance, as shown in FIG. 6, an actuator cooperates with an intake or exhaust valve 26 and comprises an anchor of ferromagnetic material 27 joined rigidly to a stem 28 of the valve 26 and disposed perpendicular to its longitudinal axis C, a pair of electromagnets 29 at least partially bounding the stem 28 or the valve 26 and disposed on opposite sides with respect to the anchor 27, so as to be able to act, on command, alternatively simultaneously, by exerting a net force F on the anchor 27 in order to cause it to move in translation parallel to the longitudinal axis C and an elastic member 30 adapted to maintain the anchor 27 in a rest position in which it is equidistant from the polar heads of the two electromagnets 29 so as to maintain the valve 26 in an intermediate position between the closed position (upper contact) and the position of maximum opening (lower contact) that the valve 26 assumes when the anchor 27 is disposed in contact with the polar head of the upper electromagnet 6 and respectively with the polar head of the lower electromagnet 6.

It will be appreciated that modifications and variations may be made to the above description without departing from the scope of the present invention.

What is claimed is:

1. A method for the control of electromagnetic actuators for the actuation of intake and exhaust valves in internal combustion engines, in which an actuator, connected to a control unit, is coupled to a respective valve and comprises a moving member actuated magnetically to control the movement of the valve between a closed position and a position of maximum opening and an elastic member adapted to maintain the valve in a rest position, the method comprising:

a) detecting an actual position and an actual velocity of the valve;

b) determining a reference position and a reference velocity of the valve;

c) minimizing differences between the reference position and the actual position and between the reference velocity and the actual velocity of the valve, by means of a feedback control action and by c1) determining an objective force value to be exerted on the moving member.

2. A method as claimed in claim 1, wherein the step c1 of determining the objective force value comprises:

c11) calculating this objective force value as a function of the reference position, the actual position, the reference velocity and the actual velocity.

3. A method as claimed in claim 2, wherein the step c11) of calculating the objective force value as a function of the reference position, the actual position, the reference velocity and the actual velocity comprises:

c111) calculating the objective force value according to the equation:

$$F_O=(N_1Z_R+N_2V_R)-(K_1Z+K_2V) \quad (1)$$

In which $N_1$, $N_2$, $K_1$ and $K_2$ are respectively a first, second, third and fourth predetermined gain, $F_O$ is the objective force value, $Z_R$ is the reference position, Z is the actual position, $V_R$ is the reference velocity, and V is the actual velocity.

4. A method as claimed in claim 1 wherein the step of determining the objective force value precedes the step of:

c2) exerting on the moving member a net force of a value equal to the objective force value.

5. A method as claimed in claim 4, in which the actuator further comprises at least a pair of electromagnets disposed on opposite sides with respect to the moving member and in which the valve travels an opening stroke when moving from the closed position to the position of maximum opening and a closing stroke when moving from the position of maximum opening to the closed position, wherein step c2) of exerting a net force comprises:

c21) supplying electric current to both the electromagnets during each opening and closing stroke of the valve.

6. A method as claimed in claim 5 wherein step c21 of supplying electric current to both the electromagnets comprises:

c211) supplying electric current to the electromagnets repeatedly in sequence.

7. A method as claimed in claim 5 wherein step c21 of supplying electric current to both the electromagnets further comprises:

c212) calculating at least a first and second objective current value having a value equal to the first and the second objective current value respectively; and c213) supplying the pair of electromagnets with a first and a second current having a value equal to the first and the second objective current value respectively.

8. A method for the control of electromagnetic actuators for the actuation of intake and exhaust valves in internal combustion engines, in which an actuator, connected to a control unit, is coupled to a respective valve and comprises a moving member actuated magnetically to control the movement of the valve between a closed position and a position of maximum opening and an elastic member adapted to maintain the valve in a rest position, the method comprising:

a) detecting an actual position and an actual velocity of the valve;

b) determining a reference position and a reference velocity of the valve;

c) minimizing differences between the reference position and the actual position and between the reference velocity and the actual velocity of the valve, by means of a feedback control action, wherein the step b) of determining the reference position and the reference velocity comprises:

b1) generating an objective position signal indicative of position; and b2) processing the objective position signal by means of filtering means.

* * * * *